United States Patent [19]

MacKenzie

[11] 4,363,565

[45] Dec. 14, 1982

[54] TUNNELLING

[76] Inventor: Colin N. P. MacKenzie, 5 Saltash Close, Loudwater, Buckinghamshire, England

[21] Appl. No.: 122,788

[22] Filed: Feb. 19, 1980

[30] Foreign Application Priority Data

Feb. 21, 1979 [GB] United Kingdom ..... 7906046

[51] Int. Cl.[3] ..... E21D 9/06; E21D 11/05

[52] U.S. Cl. ..... 405/146; 405/152

[58] Field of Search ..... 405/146, 150, 151, 152, 405/153, 141

[56] References Cited

U.S. PATENT DOCUMENTS

| | | | |
|---|---|---|---|
| 1,336,789 | 4/1920 | Sheen | 405/146 X |
| 4,075,855 | 2/1978 | Meldner | 405/152 |
| 4,201,497 | 5/1980 | Artweger | 405/150 |
| 4,237,182 | 12/1980 | Fulmer et al. | 405/150 X |

FOREIGN PATENT DOCUMENTS

| | | | |
|---|---|---|---|
| 821190 | 8/1969 | Canada | 405/146 |
| 2646334 | 4/1978 | Fed. Rep. of Germany | 405/150 |
| 350677 | 1/1961 | Switzerland | 405/146 |
| 1508040 | 4/1978 | United Kingdom | 405/150 |

*Primary Examiner*—David H. Corbin

*Attorney, Agent, or Firm*—Larson & Taylor

[57] ABSTRACT

The invention is concerned with a method of constructing a lined tunnel using a tunnelling shield having a tall skin and in which the tunnel lining is of the expanded type comprising a number of ring sections 4 fitted together end to end and in which each ring section 4 is formed from a number of arcuate segments 5 which are fitted together circumferentially and which are expanded radially into contact with the surrounding ground 1. The expansion may be effected by means of one or more wedges which are driven between pairs of the segments, or by jacks which are expanded between segments. In the method each ring section 4 of the tunnel lining is erected by first assembling its segments 5 to form the new ring section 4*a* in an unexpanded state within the tail skin 2 of the tunnelling shield while a thin rear extension 3 of the tail skin 2 overlaps the leading end of the previously erected and fully expanded ring section 4*b* and whereby an annular layer of resilient compressible material 6 is located around the newly assembled ring section 4*a*, the annular layer of resilient compressible material 6 being formed by layers of the material attached to the outer surfaces of the individual segments 5. The newly assembled ring section 4*a* is then pushed against the leading end face of the previously erected ring section 4*b* and is partially expanded so that the layer of compressible material 6 is partially compressed against the inside of the tail skin 2 and its extension 3 as shown. The tunnelling shield is then advanced until its thin rear extension 3 overlaps the leading end of the new ring section 4*a*, and the new ring section 4*a* is then further expanded until it reaches its fully expanded condition.

8 Claims, 5 Drawing Figures

TUNNELLING

This invention relates generally to the construction of lined tunnels in which the tunnel is driven using a tunnelling shield and is lined by erecting a series of ring sections end to end behind the shield as the tunnel is advanced.

A tunnelling shield comprises a cylindrical shell and is used to support the ground immediately adjacent the face of the tunnel which is being excavated and also to protect the apparatus and persons operating at the tunnel face, and is advanced axially to keep up with the tunnel face during excavation. Indeed, the excavation may be carried out by the shield itself if the leading end of the shell is provided with a rotary cutting head, but often the excavation will be affected by a separate cutter which is mounted within the shield. The shield is advanced by means of a series of hydraulic jacks, known as shove rams, spaced circumferentially around the inside of the shell. The shove rams are arranged to thrust against a suitable stop, such as the leading end of the tunnel lining which has already been erected, and at the end of their stroke excavation is stopped and the rams are retracted to allow the next ring section of the tunnel lining to be erected, the section usually comprising a number of arcuate prefabricated concrete or metal segments which are fitted together in the circumferential direction and adjacent the leading end of the preceding section of the lining.

When tunnelling in ground which is sufficiently firm to support itself for relatively short periods of time, the tunnel lining which is erected is often of the expanded type. A tunnel lining of the expanded type is a lining comprising a number of ring sections fitted together end to end and in which each ring section is formed from a number of arcuate segments which are fitted together circumferentially and which are expanded radially, by means of one or more wedges or jacks which are driven or expanded respectively between one or more pairs of the segments, to provide the ring section with the required diameter. Each wedge may in fact be one of the segments, at least one of its circumferentially facing end faces being wedge shaped and co-operating with a correspondingly wedge shaped face on the adjacent segment so that axial movement of the wedge segment expands the ring section. Each new ring section is erected immediately behind the tunnelling shield and is designed to be expanded radially until its outer surface is forced tightly against the surrounding ground forming the tunnel wall.

An advantage of such an expanded lining is that once expanded against the surrounding ground, it is a stable structural unit without further fixings, although expanded linings are sometimes formed with segments which are bolted together, or are clipped together by other means, in the fully expanded position. In addition, the lining offers an immediate support to the surrounding ground, and there is no intermediate space which must be filled by a suitable grouting material in order to ensure load transfer between the surrounding ground and the tunnel lining. Also, as the tunnel lining is preloaded by being expanded against the surrounding ground, the degree of settlement of the ground above the tunnel caused by the tunnelling may be reduced.

When tunnelling in ground, such as soft or relatively loose ground, which is not capable of supporting itself for any period of time, the tunnelling shield will have a portion, known as a tail-skin, which extends rearwards beyond the shove rams, so that, after the advance of the shield during an excavation cycle, the rear end of the tail skin still overlaps the leading end of the tunnel lining already erected, and the new ring section is therefore erected within the protection of the tail skin. For obvious reasons, the necessity to erect each new ring section within the confine of the tunnelling shield tail skin has, until now, prevented the use of a lining of the expanded type as described above. The aim of the present invention is to change this situation by providing a method of constructing a lined tunnel which may be used in soft and unself-supporting ground, particularly in sands and gravels, and in which the lining is of the expanded type, with the resulting advantages thereof, and is erected without exposing the tunnel wall at any stage.

According to the invention, a method of constructing a lined tunnel in which the tunnel is excavated using a tunnelling shield having a tail skin and the lining is of the expanded type as hereinbefore described, is characterised in that the tail skin of the tunnelling shield has a thin rear end portion of greater internal diameter, and in that each ring section of the lining is erected by assembling its segments to form the ring section in an unexpanded state within the tail skin of the tunnelling shield while the thin rear end portion of the tail skin overlaps the leading end of the previously erected and fully expanded ring section and whereby a layer of resilient compressible material is located around the newly assembled ring section, pushing the new ring section against the leading end face of the previously erected ring section and partially expanding the new ring section so that the layer of compressible material is partially compressed against the inside of the tail skin, advancing the tunnelling shield until the thin rear end portion of the tail skin overlaps the leading end of the new ring section, and then further expanding the new ring section to its fully expanded condition.

At this stage, which corresponds to the starting position of the erection cycle, the portion of the layer of compressible material adjacent the leading end of the newly erected ring section will be substantially fully compressed against the surrounding thin rear end portion of the tail skin, and the remainder of the layer of compressible material will be partially compressed against the surrounding ground forming the wall of the tunnel. When the tunnelling shield is next advanced, the thin rear end portion of the tail skin will be pulled away from the leading end of the fully expanded ring section, thereby allowing the compressed leading end portion of the layer of compressible material to recover (due to the resilience of the material) until it contacts the tunnel wall.

An essential feature of the present invention is of course the use of a layer of resilient compressible material around each ring section of the lining. This layer may be a single layer of a single material, or it may, if desired, take the form of a laminate of one or more different materials depending on how the layer is required to perform. In either case the thickness, compressibility and resilience of the layer should be such that when each new ring section is partially expanded and compressed against the inside of the tail skin, and the tunnelling shield is subsequently advanced, the partially compressed resilient material will recover firstly against the thin rear end portion of the tail skin and secondly against the tunnel wall exposed behind the thin rear end portion as the tail skin moves forward with the tunnelling shield. In this way the tunnel wall is never exposed at any stage during the construction of the tunnel, and is always supported over its whole length.

Preferably each of the arcuate segments which form each new ring section of the lining has a layer of resilient compressible material attached to its outer surface whereby the layer of resilient compressible material which surrounds each ring section is formed by the resilient compressible material on the outer surfaces of its component segments. The layer of resilient compressible material which is attached to the outer face of each segment may be adhesively bonded or mechanically fixed to the segment, and is preferably formed by any suitable foamed synthetic elastomeric material, such as foamed polyethylene. Alternatively the layer may be formed of wood wool, cork, or some other similar material, or it may comprise a number of different materials if it is of laminated construction as mentioned earlier.

Because the rear end portion of the tunnelling shield is always in contact with the resilient compressible material around the leading ring section or sections of the lining during construction of a tunnel, the method in accordance with the invention has the advantage that, depending on the nature of the resilient compressible material, there will be a good water seal between the tunnelling shield and the tunnel lining. This means that the method in accordance with the invention could be particularly useful when operated with a hydroshield or a bentonite shield for driving tunnels in water bearing grounds.

In this case it is necessary to ensure that there is also a good water seal formed between adjacent ring sections of the tunnel lining. This may be achieved by arranging that, when each new ring section is pushed against the leading end face of the previously erected section, a sealing ring or compound is clamped between the axial end faces of the adjacent ring sections. However, with this method it is possible that the seal can be damaged when the new ring section is expanded, and preferably therefore the seal between adjacent ring sections is formed by means of a sealing ring which is clamped radially between a rearward projection at the rear inner edge of the foremost of the two sections and a forward projection at the front outer edge of the rearmost of the two sections. In this case a resilient elastomeric sealing ring is preferably located around the radially outer surface of the rearward projection of each new ring section before it is pushed rearwards against the preceding section whereby, when the new ring section is subsequently expanded, the sealing ring is also expanded and is compressed against the radially inner surface of the forward projection of the preceding section. Provided that the axial extent of the overlapping projections is sufficient, i.e. greater than the thickness of the sealing ring, there will be substantially no contact between the sealing ring and the opposing axial end faces of the ring sections, at least during expansion of the new section. Also, the combined radial thickness of the forward and rearward projections should be less than the thickness of the segments in order to accommodate the sealing ring while maintaining substantially continuous inner and outer surfaces from section to section along the lining. In this way, a lined tunnel having good and reliable seals between adjacent ring sections of the lining can be constructed using the method in accordance with the invention.

Two examples of the method in accordance with the invention will now be described with reference to the accompanying drawings, in which.

Figure 1:
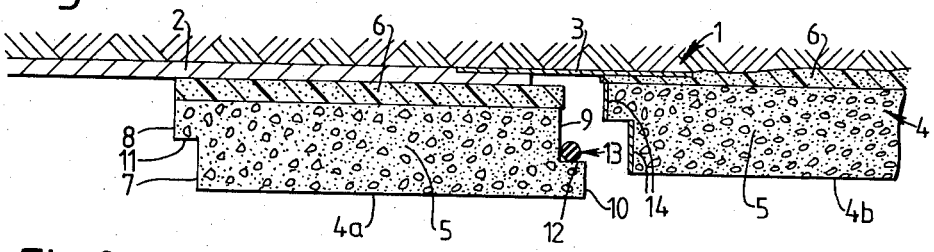
FIG. 1 illustrates an early stage in the erection of each new ring section of the tunnel lining in a first example of the method, the Figure being a diagrammatic radial section through part of the tail skin of a tunnelling shield, the new ring section which is being erected, and the leading end of the tunnel lining which has already been erected.
Figure 2:
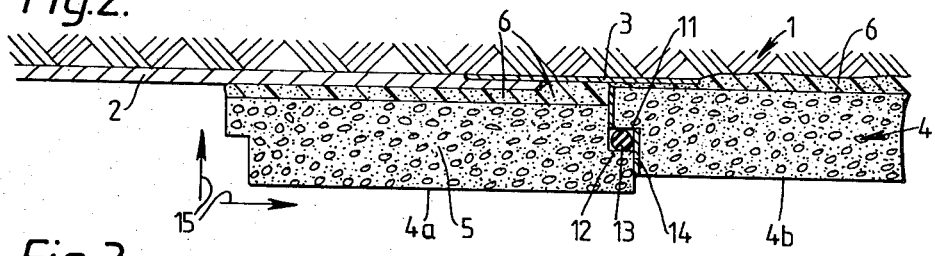
FIG. 2 is a view similar to that of FIG. 1, but illustrating a subsequent stage in the erection of the new ring section.
Figure 3:
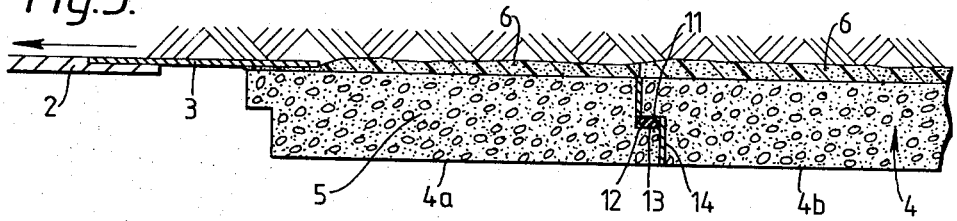
FIG. 3 is a view similar to that of FIGS. 1 and 2, but illustrating the final stage in the erection of the new ring section.

In the method illustrated in FIGS. 1 to 3, a tunnel is being driven through relatively loose ground 1, such as sand, silt, or gravel, using a tunnelling shield of which only the tail skin 2 is shown. The tunnelling shield may be of any suitable known construction except that its tail skin 2 is provided with a relatively short thin cylindrical steel extension 3 which is fixed to and extends rearwards from the rear end of the tail skin 2. The outer diameter of the extension 3 is the same as that of the tail skin 2, but because it is much thinner than the tail skin, the inner diameter of the extension is greater than that of the tail skin 2.

The tunnel lining, which is erected progressively ring section by ring section as the tunnel is driven, is of the expanded type, each ring section 4 being formed from a number of arcuate precast concrete segments 5, each of which has a uniformly thick layer 6 of a resilient and compressible foamed polyethylene (preferably of substantially closed cell structure) adhesively bonded to it over the whole of its outer surface, and being expanded radially so that the foamed polyethylene layers 6 of its component segments 5 (together forming an annular resilient and compressible layer around the ring section) are partially compressed against the surrounding ground 1. As can be seen in the drawings, each arcuate segment 5 is formed with a rebate 7 at its front inner edge, thereby forming a forward projection 8 at its front outer edge and extending along the entire circumferential extent of the front edge. In addition, the segment 5 has a correspondingly dimensioned rebate 9 at its rear outer edge, thereby forming a rearward projection 10 extending along the circumferential extent of its rear inner edge. The projections 8 and 10 have radially inner and outer surfaces 11 and 12 respectively which extend parallel to the inner and outer faces of the segment 5, and the radial extent of each projection 8, 10, is slightly less than half the thickness of the segment 5.

The erection of each new ring section of the tunnel lining will now be described starting from the position shown in FIG. 1 in which the tunnelling shield has completed an excavation cycle, its shove rams have been retracted to provide space for the erection of the new ring section within the tail skin 2, and the rear end of the tail skin extension 3 overlaps the leading end of the previously erected and fully expanded ring section. The new ring section 4*a* is then erected by assembling its component segments 5 to form the ring section in an unexpanded state within the tail skin 2 and spaced slightly axially from the preceding ring section 4*b*. In this position a resilient elastomeric O-ring seal 13 is seated around the annular surface 12 formed by the projections 10 at the rear inner edges of the assembled segments 5. Also, if any packing is required between the new ring section 4*a* and the previous section 4*b*, such as when the tunnel is being curved, this is placed as necessary on the front end faces of the previously erected ring section 4*b* as shown at 14.

As indicated by the arrows 15 in FIG. 2, the new ring section 4*a* is then pushed rearwards in its unexpanded state by means of the tunnelling shield shove rams until its rear end faces abut the packing 14 on the front end faces of the previously erected ring section 4*b*, and the new ring section is partially expanded to about the position shown. In this position the rear end portion of the annular layer of resilient compressible material 6 surrounding the new ring section 4*a* is under slight compression against the inside of the tail skin extension 3, and the rest of the layer of resilient compressible material 6 is compressed to a much greater extent against the inside of the tail skin 2.

When this position is reached, a new excavation cycle is commenced, the tunnelling shield being advanced by means of its shove rams acting against the front end of the new and partially expanded ring section 4*a*. As the tunnelling shield advances, the part of the resilient compressible layer 6 previously compressed against the inside of the tail skin 2 recovers against the inside of the tail skin extension 3, and the parts previously compressed against the extension 3 recover towards the ground 1 behind the extension. At the end of the excavation cycle, the tunnelling shield has advanced to the position in which it is shown in FIG. 3 and in which the rear end of the tail skin extension 3 overlaps the leading end of the new ring section 4*a*, which at this stage is still only partially expanded.

The new ring section 4*a* is then fully expanded into the position in which it is shown in FIG. 3. In this position the resilient compressible material 6 at the front end of the ring section 4*a* is fully compressed against the inside of the tail skin extension 3, and the remainder of the material 6 is partially compressed against the surrounding ground forming the tunnel wall. In addition, the O-sealing ring 13 is compressed tightly between the overlapping faces 11 and 12 at the leading end of the preceding ring section 4*b* and the rear end of the new ring section 4*a* respectively. This position corresponds to the starting position described with reference to FIG. 1 and the same erection procedure is then followed in erecting the next ring section.

Figure 4:
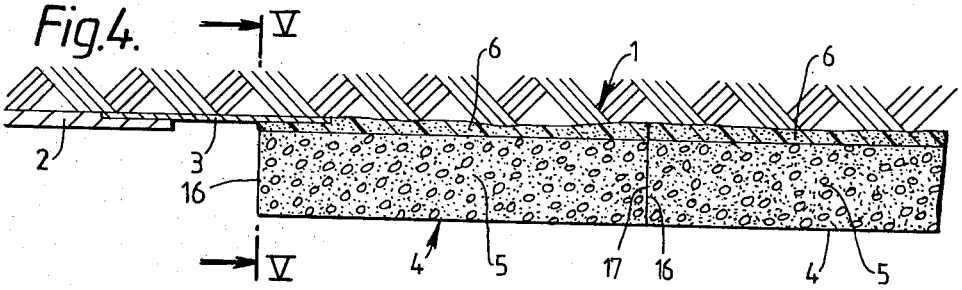
FIG. 4 is a view similar to that of FIG. 3, but illustrating the final stage in a second example of the method in accordance with the invention
Figure 5:
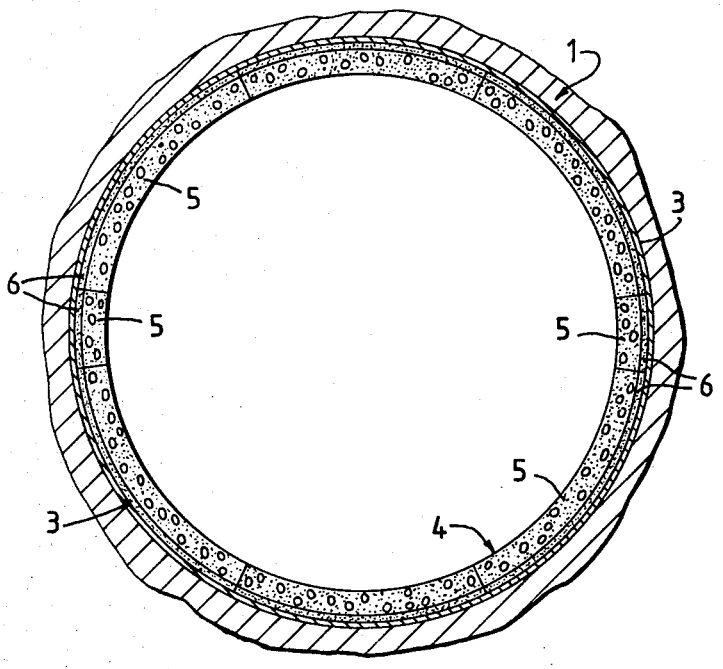
FIG. 5 is a transverse cross-section taken on the line V—V in FIG. 4 and showing the leading end face of the newly erected and expanded ring section still surrounded by the thin rear end portion of the tunnelling shield tail skin.

The example of the method in accordance with the invention illustrated by FIG. 4 is suitable for use when there is little or no water seepage problem during tunnelling. The method is exactly the same as that described with reference to FIGS. 1 to 3, except that the arcuate segments 5 which form each ring section 4 of the tunnel lining have parallel planar front and rear end faces 16 and 17 respectively, and there is no sealing ring 13 placed between the adjacent end faces 16, 17 of neighbouring ring sections 4. Parts which are shown in FIG. 4 and which correspond to parts shown in FIGS. 1 to 3 have been given the same numerals as in FIGS. 1 to 3.

I claim:

1. A method of constructing a lined tunnel wherein said tunnel is excavated using a tunnelling shield having a tail skin, and the lining is of the expanded type comprising a series of ring sections erected end to end behind the shield as the tunnel is advanced, each new ring section being formed from a number of arcuate segments which are fitted together circumferentially in front of the previously erected sections and which are expanded radially to provide the new ring section with the required diameter, said method characterised by:

(1) providing said tail skin of said tunnelling shield with a thin rear end portion of greater internal diameter than said tail skin proper; and (2) erecting each new ring section of said lining by a process comprising the steps of:

(a) assembling the segments of said new ring section to form said ring section in an unexpanded state within said tail skin of said tunnelling shield while said thin rear end portion of said tail skin overlaps the leading end of the previously erected and fully expanded ring section of said lining;

(b) providing a layer of resilient compressible material around said newly assembled ring section;

(c) pushing said new ring section against said leading end face of said previously erected ring section;

(d) partially expanding said new ring section whereby said layer of resilient compressible material is partially compressed against the inside of said tail skin;

(e) advancing said tunnelling shield until said thin rear end portion of said tail skin overlaps the leading end of said new ring section; and, (f) further expanding said new ring section until said section reaches the fully expanded condition.

2. A method according to claim 1, wherein each of said arcuate segments from which said new ring section is erected is provided with a layer of resilient compressible material attached to the outer surface of said segment whereby said layer of resilient compressible material which surrounds said ring section is provided by the resilient compressible material attached to the outer surfaces of the component segments of said ring section.

3. A method according to claim 2, wherein said layer of resilient compressible material attached to said outer face of each segment is adhesively bonded to said segment.

4. A method according to claim 1, wherein said resilient compressible material is a foamed synthetic elastomeric material.

5. A method according to claim 4, wherein said resilient compressible material is foamed polyethylene.

6. A method according to claim 1, including the further step of clamping sealing means between said new ring section and said leading end of said previously erected ring section of said tunnel lining.

7. A method according to claim 6, wherein said new ring section is provided with a rearward projection at its rear inner edge and said previously erected ring section is provided with a forward projection at its front outer edge, and said sealing means comprises a sealing ring which is clamped radially between said forward and rearward projections.

8. A method according to claim 7, wherein said sealing ring is made of a resilient elastomeric material and is located around the radially outer surface of said rearward projection of said new ring section before said new ring section is pushed rearwards against said previously erected ring section whereby, when said new ring section is subsequently expanded, said sealing ring is also expanded and is compressed against the radially inner surface of said forward projection of said previously erected ring section.

* * * * *